US008596254B2

(12) United States Patent
Brooks et al.

(10) Patent No.: US 8,596,254 B2
(45) Date of Patent: Dec. 3, 2013

(54) TOY LAUNCHER APPARATUS WITH FIXED LOADABLE MAGAZINE

(75) Inventors: Meredith Brooks, Attleboro, MA (US); Kevin C. Dakan, Warwick, RI (US)

(73) Assignee: Hasbro, Inc., Pawtucket, RI (US)

( * ) Notice: Subject to any disclaimer, the term of this patent is extended or adjusted under 35 U.S.C. 154(b) by 415 days.

(21) Appl. No.: 12/954,015

(22) Filed: Nov. 24, 2010

(65) Prior Publication Data

US 2012/0125304 A1 May 24, 2012

(51) Int. Cl.
*F41B 7/08* (2006.01)

(52) U.S. Cl.
USPC ..... 124/52

(58) Field of Classification Search
USPC ..... 124/52, 46, 48, 51.1, 53; 42/1.02, 11, 42/17, 21, 24, 29, 33, 35, 37, 39
See application file for complete search history.

(56) References Cited

U.S. PATENT DOCUMENTS

| | | | |
|---|---|---|---|
| 961,511 | A | 6/1910 | Marble |
| 1,331,155 | A | 2/1920 | Johnson |
| 1,374,757 | A | 4/1921 | Napier |
| 2,908,987 | A | 10/1959 | Allyn |
| 3,968,783 | A | 7/1976 | Pfotenhauer |
| 4,139,959 | A | 2/1979 | Howard et al. |
| 4,170,215 | A | 10/1979 | Kettlestrings |
| 4,248,202 | A | 2/1981 | Jaworski et al. |
| 4,659,320 | A | 4/1987 | Rich et al. |
| 5,471,967 | A | 12/1995 | Matsuzaki et al. |
| 5,529,050 | A | 6/1996 | D'Andrade |
| 5,611,322 | A | 3/1997 | Matsuzaki et al. |
| 5,956,878 | A | 9/1999 | Yang |
| 5,996,564 | A | 12/1999 | Kotowski |
| 6,224,457 | B1 | 5/2001 | Wu |
| 6,250,294 | B1 | 6/2001 | Lim |
| 6,598,329 | B1 | 7/2003 | Alexander |
| 6,733,356 | B2 | 5/2004 | Lee |
| 7,287,526 | B1 | 10/2007 | Bligh et al. |
| 7,418,797 | B1 | 9/2008 | Crose |
| 7,437,847 | B1 | 10/2008 | Mabry |
| 7,552,557 | B1 | 6/2009 | Mabry |
| 7,673,624 | B2 | 3/2010 | Rosella, Jr. |
| 2006/0180134 | A1 | 8/2006 | Illuzzi |
| 2006/0242880 | A1 | 11/2006 | Griffin |
| 2009/0229158 | A1 | 9/2009 | Victor |
| 2009/0249672 | A1 | 10/2009 | Zedrosser |

*Primary Examiner* — Gene Kim
*Assistant Examiner* — Amir Klayman
(74) *Attorney, Agent, or Firm* — Perry Hoffman

(57) ABSTRACT

A toy launcher apparatus for discharging soft foam projectiles, the apparatus having a housing, a projectile launching assembly including a launching tube and a launching spring, a trigger and a cocking assembly. The apparatus also includes a magazine container for storing a stack of projectiles and having a projectile receiving opening to enable loading of projectiles into the magazine container without removing the magazine container from the housing.

10 Claims, 15 Drawing Sheets

TOY LAUNCHER APPARATUS WITH FIXED LOADABLE MAGAZINE

FIELD OF THE INVENTION

The present invention relates to a toy launcher apparatus with a fixed loadable magazine, and, more particularly, to a readily loadable magazine for a toy launcher apparatus where the magazine may be easily and quickly loaded with projectiles during play without the need to remove the magazine from the toy launcher apparatus.

BACKGROUND OF THE INVENTION

Toys are often designed to have play value by simulating a real object. Toy guns and rifles have been marketed for decades and include such devices as water pistols and rifles, cap guns, BB guns and rifles, dart guns and NERF brand launchers that discharge a soft foam toy dart or projectile. New and fresh features are desirable but creating and developing such features in a successful manner have proven difficult.

Typical rifle magazines, both for real weapons and sport and toy devices, are shown in earlier U.S. patents although all are detachable and must be removed to be loaded. For example, U.S. Pat. No. 1,331,155 for a "Box Magazine For Firearms" issued in 1920 to T. C. Johnson, purports to disclose a removable curved magazine made of inexpensive sheet metal to serially load cartridges into a firearm, the magazine having a spring at the bottom of the magazine and an open top. In 1959, U.S. Pat. No. 2,908,987 issued for a "Firearm With Side Loading Magazine" to Allyn, and purports to disclose a detachable side loading, box type, one-piece stamped magazine with a spring mounted in the bottom of the magazine and having an open side for cartridges. In 1979, U.S. Pat. No. 4,139,959 for a "Cartridge Magazine" issued to Howard et al., and purports to disclose a removable curved molded plastic magazine with a follower that may tilt without binding. The magazine has an open upper end and a closure plate with a latch at a lower end. The follower includes a post to prevent the latch from releasing the closure plate when the follower is at its lowest position indicating a fully loaded magazine. Twenty years later, U.S. Pat. No. 5,956,878 for a "Cartridge Magazine For A Firearm" issued to Yang, and purports to disclose a detachable cartridge magazine having a bullet support with guiding extrusions to balance the support.

U.S. Pat. No. 6,250,294 for an "Air Compression Type Shooting Device Using Adhesion Type Bullet" issued in 2001 to Lim, and purports to disclose a toy gun for shooting VELCRO brand tipped soft "bullets" using compressed air. The bullets are loaded in a detachable magazine having a closed bottom and internal spring and an open top. In 2006, U.S. Patent Application Publication, 2006/0180134 appeared for a "Combination Solid Projectile And Paintball Gun, and Solid Projectile Adapter For Paintball Gun" and purports to disclose a compressed air paint gun adapted to shoot solid projectiles where some of the magazines shown are mounted atop a barrel to allow ammunition to be gravity fed, and some of the magazines are attached to removable adapters to be added to the gun where the magazines includes internal springs and the magazines are separately loaded and then attached. In 2009, U.S. Patent Application Publication, 2009/0229158 appeared for a "Magazine With Constant-Force Spring For Dispensing Elastomeric Foam Projectiles" and purports to disclose a detachable magazine with a constant force, negator coil, spring. The magazine is closed at its bottom and open at its top. Also in 2009, U.S. Patent Application Publication, 2009/02496672 appeared for a "Firearm With An Ergonomic Reloading Control Group" and purports to disclose a firearm that facilitates removal of a detachable empty magazine and return of a bolt as part of reloading the firearm.

These patents are of little interest, however, because they describe devices that use the usual magazine, i.e., one that is detachable with a closed bottom, a biasing spring, and open top, and which are loaded when separated from the weapon or toy and then connected to the weapon or toy. Only gravity fed hoppers or magazines are able to be loaded, without removal of the hopper or magazine.

SUMMARY OF THE INVENTION

In accordance with the present invention, an advantageous method and apparatus are provided in the form of a toy launcher apparatus that simulates a pump action assault rifle with a fixed projectile magazine that may be loaded at any time, except during a momentary cocking cycle, without detaching the magazine as is typically required. The toy launcher apparatus of the present invention discharges soft foam toy projectiles or darts and includes an open top projectile magazine that allows insertion of projectiles without the magazine being removed from the toy launcher apparatus. The toy launcher apparatus includes safety features such as a block of the apparatus' breech to prevent injury of the user's fingers from being pinched, and projectile jams are prevented so that the breech does not receive more than one projectile at a time. During the cocking cycle, the opening of the magazine is also blocked so as to prevent interference from a loading projectile. The toy launcher apparatus also has the advantages of being relatively simple, easy to operate, fun to use, safe, relatively inexpensive, compact, and yet, structurally robust.

Briefly summarized, the invention relates to a toy launcher apparatus including a housing, a projectile launching assembly mounted to the housing, the launching assembly including a breech, a trigger assembly mounted to the housing and operatively connected to the projectile launching assembly to activate the projectile launching assembly, a magazine container mounted to the housing, the magazine container having a projectile receiving opening in an upper portion to enable loading of projectiles into the magazine container without removing the magazine container from the housing, a first panel operatively connected to the housing adjacent to the projectile receiving opening in the top portion of the magazine container and movable between first and second positions, and when in the first position the first panel does not block the projectile receiving opening in the upper portion of the magazine container, and when in the second position the first panel blocks the projectile receiving opening in the upper portion of the magazine container, a second panel operatively connected to the housing adjacent to the breech of the launching assembly and movable between first and second positions, and when in the first position the second panel blocks the breech, and when in the second position the second panel does not block the breech, a projectile loader operatively connected to the magazine container and movable between first and second positions, and when moving from the first position to the second position the projectile loader inserts a projectile into the breech, and a cocking assembly mounted to the housing, the cocking assembly to enable movement of the first panel, the second panel and the projectile loader.

The invention also relates to a method for manufacturing a magazine system for a toy projectile launcher that enables the magazine to be loaded while the magazine is attached to the toy projectile launcher, the method including the steps of forming an elongated container having a projectile receiving opening in an upper portion of the container, mounting a first panel adjacent to the upper portion of the elongated container, arranging the first panel to move between a first position and a second position, where in the second position the first panel blocks the projectile receiving opening, mounting a second panel adjacent to the upper portion of the elongated container, arranging the second panel to move between a breech blocking position and a breech unblocked position, mounting a projectile loader adjacent to the upper portion of the elongated container, and arranging the projectile loader to move between a first position and a second position for moving a projectile into the breech.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
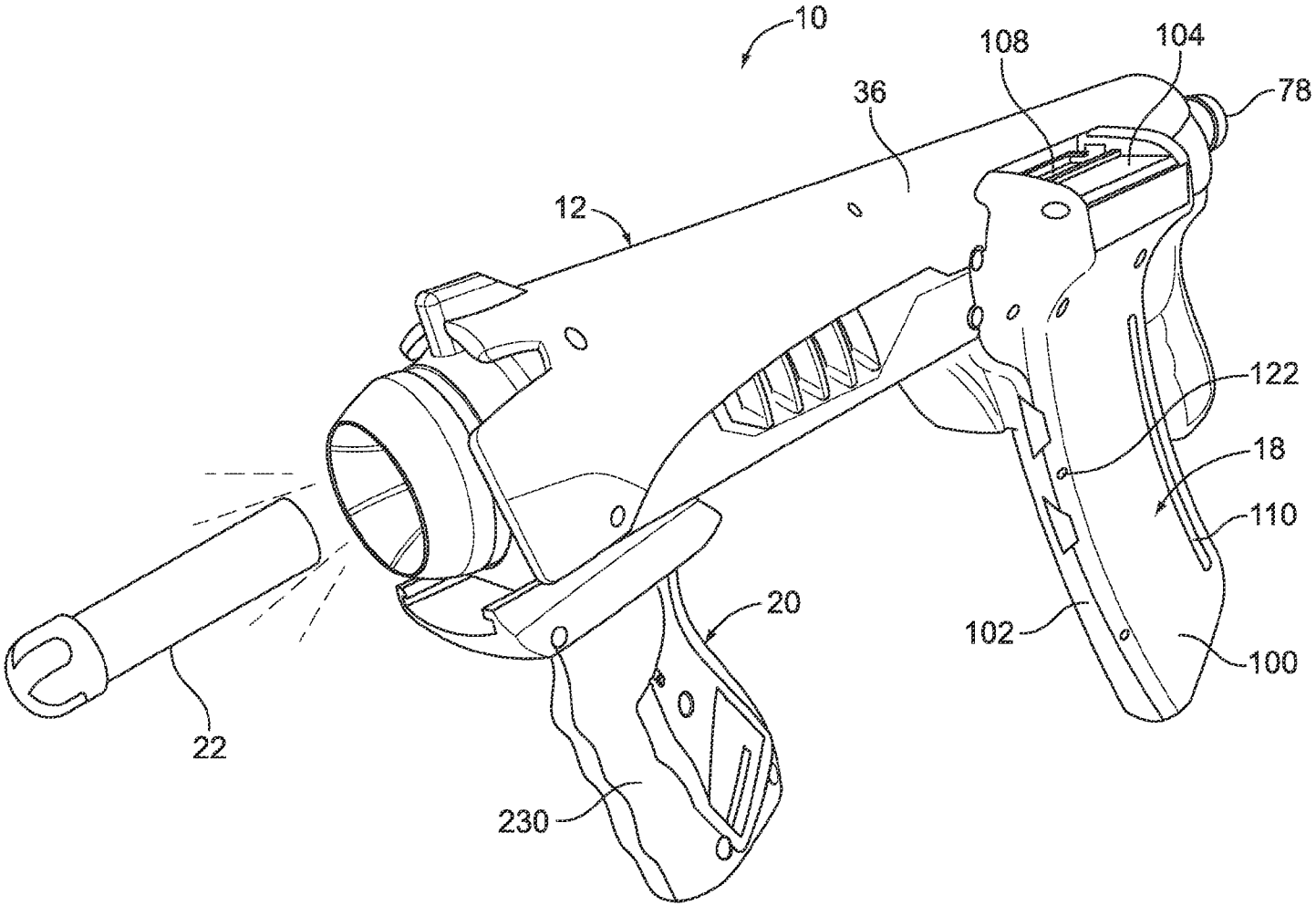
FIG. 1 is a front isometric view of a preferred embodiment of the present invention in the form of a toy launcher apparatus illustrating a discharging projectile.
Figure 2:
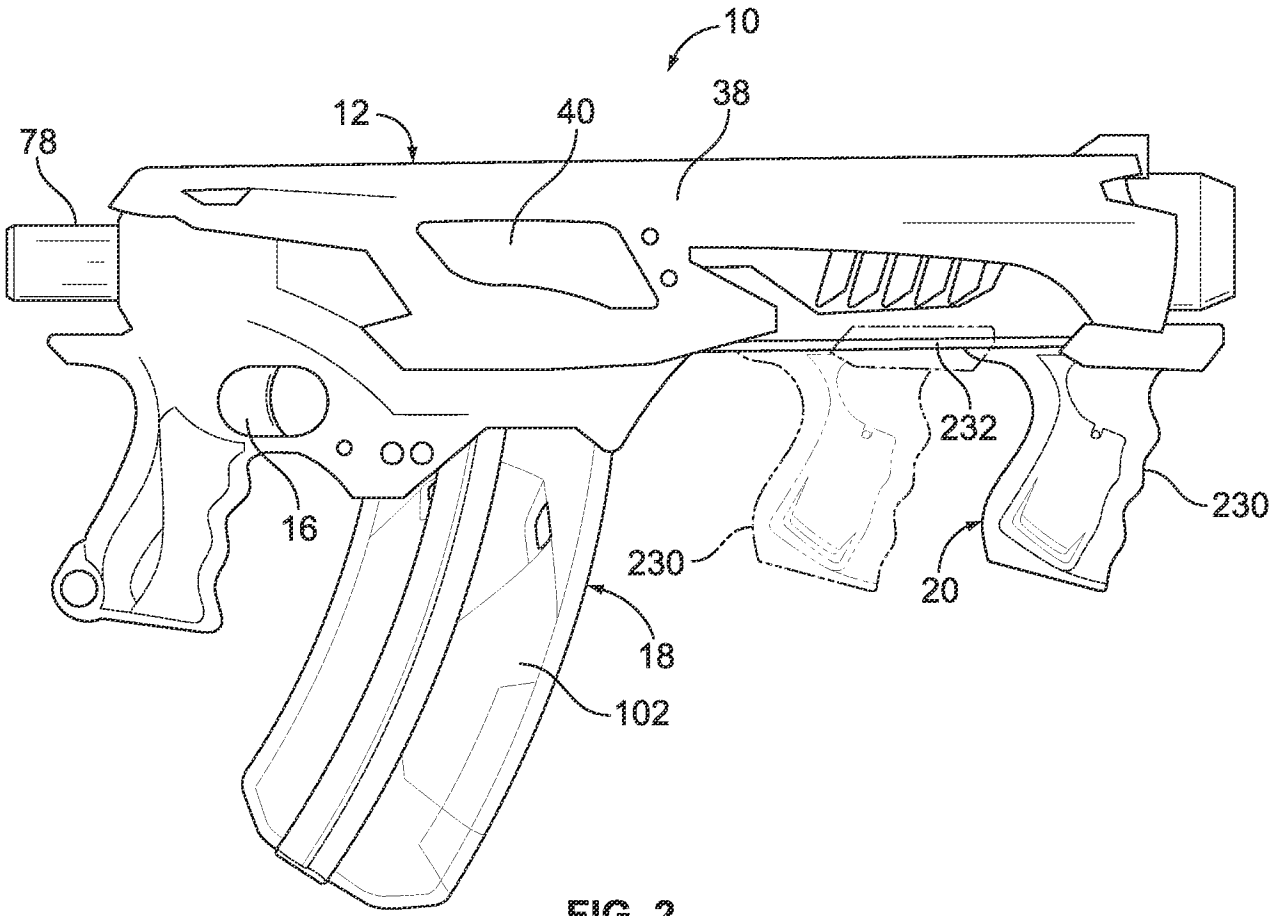
FIG. 2 is a right side elevation view of the toy launcher apparatus shown in FIG. 1.
Figure 3:
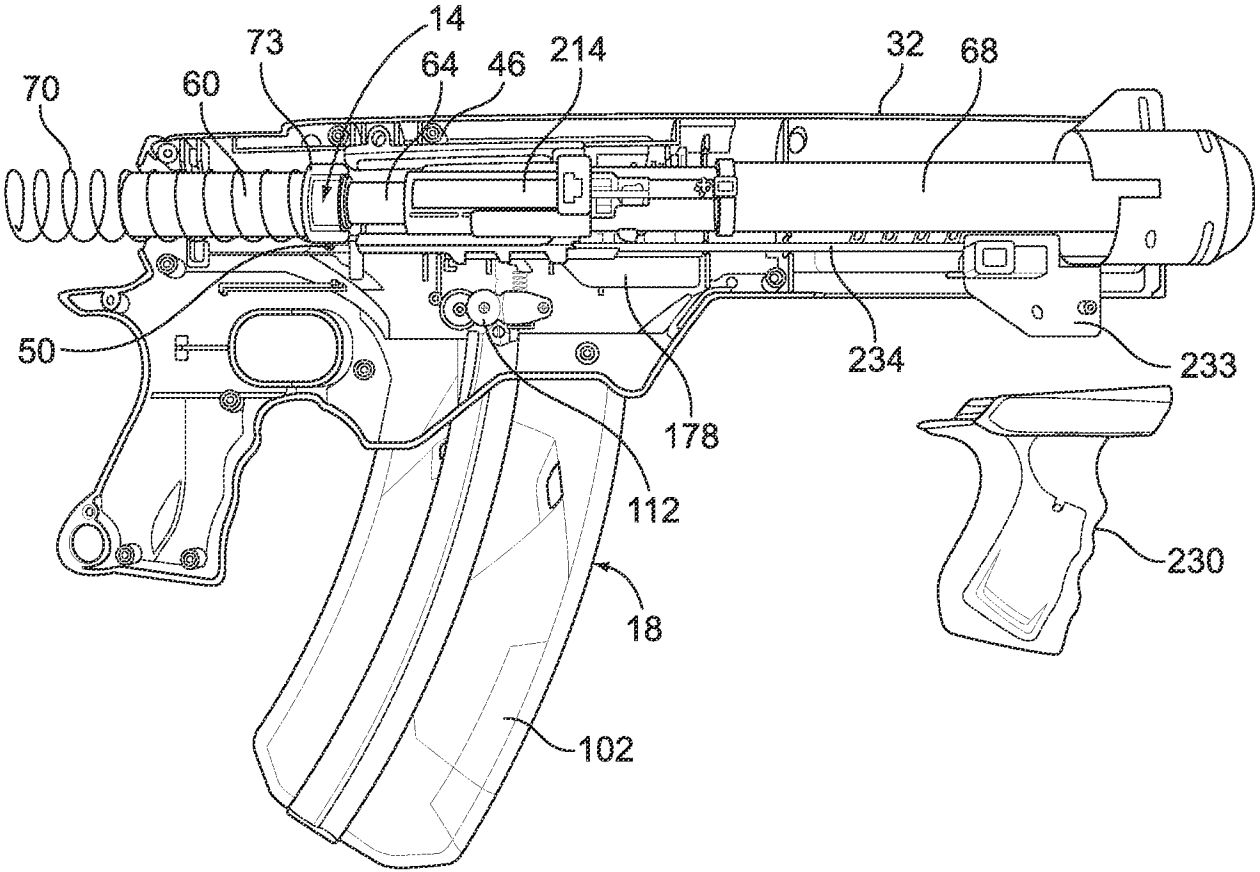
FIG. 3 is a side elevation view of the toy launcher apparatus like that shown in FIG. 2, but partially exploded and with a right housing half and an end cap removed to illustrated internal structures.

Referring first to FIGS. 1-3, there is shown an embodiment of the invention in the form of a toy launcher apparatus 10 configured to simulate a fanciful pump action assault rifle. The toy launcher apparatus 10 includes a housing assembly 12, a projectile launching assembly 14 mounted within the housing assembly, a trigger assembly 16 mounted to the housing assembly, a magazine assembly 18 affixed to the housing assembly and a cocking assembly 20 mounted to the housing assembly and operatively connected to the launching assembly 14, the trigger assembly 16 and the magazine assembly 18.

It is to be noted that the present description divides structures among "assemblies" for simplified organization and clarity. Structures placed in one assembly, however, may be placed in another assembly or in a sub-assembly. Or, the use of assemblies may be obviated and each structure described in detail below may be described as a stand-alone, or individually, and in relation to other structures. The use of assemblies here is not intended to be, nor are they to be considered, limiting of the present invention in any manner.

A dart or projectile 22 of the type that may be "fired" or discharged from the toy launcher apparatus 10 is illustrated in FIG. 1. In the alternative, other projectile configurations may be used with the toy launcher apparatus 10 including those with other enlarged head designs, reduced head designs, or head designs having the same diameter as the remainder of the projectile. Also in the alternative, the magazine assembly may be configured differently as may the configuration of the housing assembly. For example, the magazine assembly may be configured as a circular canister or configured to have a forward curve, that is a curve reversed from that shown. The geometry of the magazine may be a function of the geometry of the projectile being used. The housing assembly may be modeled after or simulate any real weapon, or may be wholly imaginative, and/or the housing assembly may have indicia of a popular merchandising concept. Throughout this description, words such as "forward", "rearward", "upper", "lower", "front", and "rear", as well as similar terms, such as "horizontal" and "vertical", refer to portions of the toy launcher apparatus as they are viewed in the drawings relative to other portions or in relationship to the positions of the apparatus as it will typically be held and moved during play when operated by a user.

Figure 4:
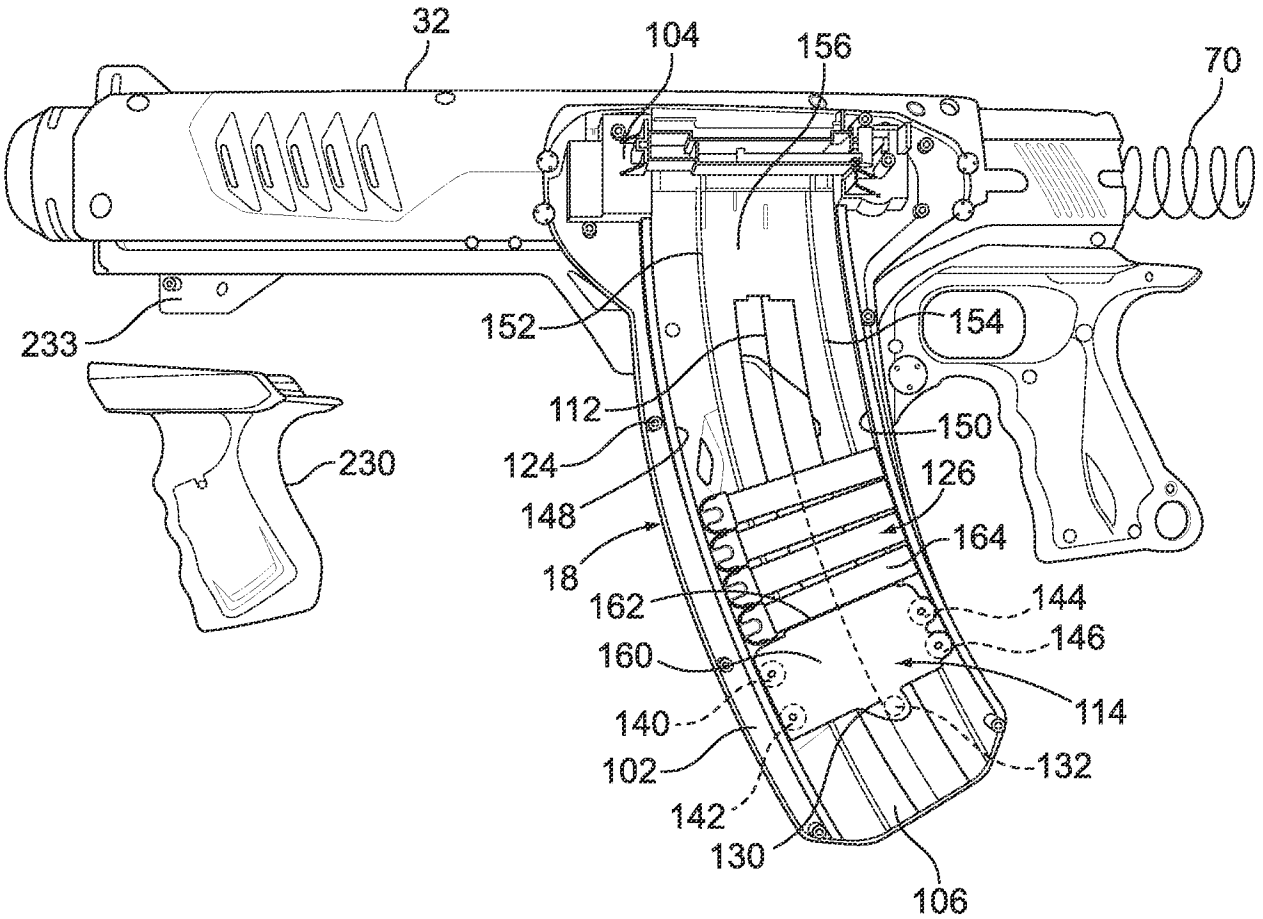
FIG. 4 is a side elevation view, partially exploded, like that shown in FIG. 3, and with an elongated wall of a magazine container removed.
Figure 5:
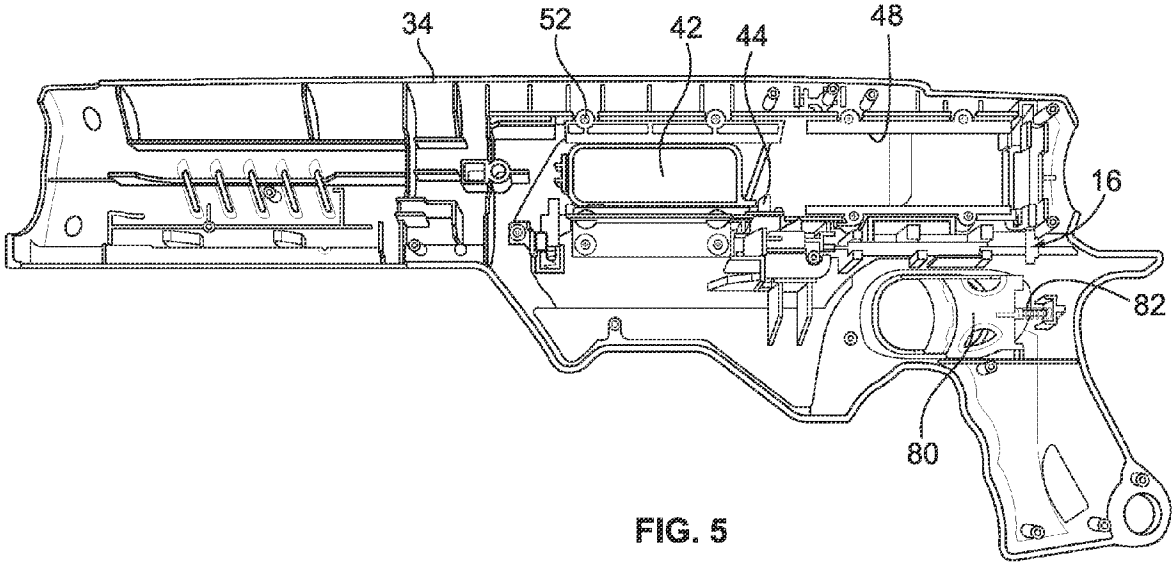
FIG. 5 is a side elevation view of the interior of the toy launcher apparatus with the left housing half removed and illustrating an access door in a closed position.
Figure 6:
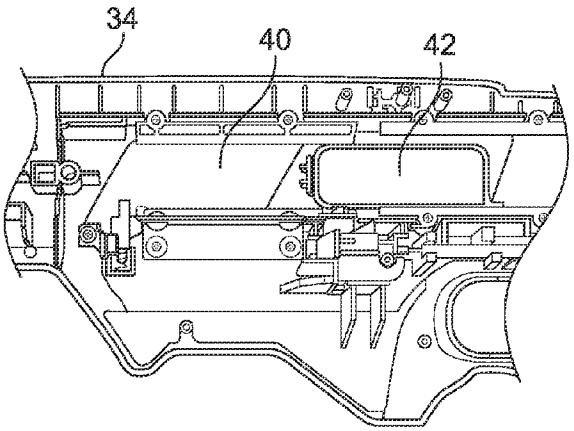
FIG. 6 is a partial side elevation view like that shown in FIG. 5, with the access door in an open position.

The housing assembly 12 may include two housing parts, a left housing part 32, FIGS. 3 and 4, and a right housing part 34, FIG. 5, outer coverings 36, 38, FIGS. 1 and 2, fastened to the left and right housing parts, an opening 40, FIGS. 2 and 6, in the right housing part 34 and outer covering 38, and a sliding door 42, FIGS. 5 and 6, mounted to the right housing part 34 for covering the opening 40. A spring-biased lock 44 for the sliding door 42 is provided to maintain the sliding door in a locked position until the loading of a projectile. The sliding door 42 is movable between a closed, locked position shown in FIG. 5, and an open, rearward position shown in FIG. 6. The opening 40 in the right housing part 34 is located to allow access to the interior of the toy launcher apparatus from outside of the apparatus to enable a user to clear jammed projectiles should that event occur. Inner frames 46, 48 FIGS. 3 and 5, are fastened to the housing assembly by any suitable means, such as by screws, exemplified by the screws 50, 52. The left and right housing parts 32, 34, the outer coverings 36, 38, and the inner frames 46, 48 may be formed from any suitable material, such as plastic.

Figure 7:
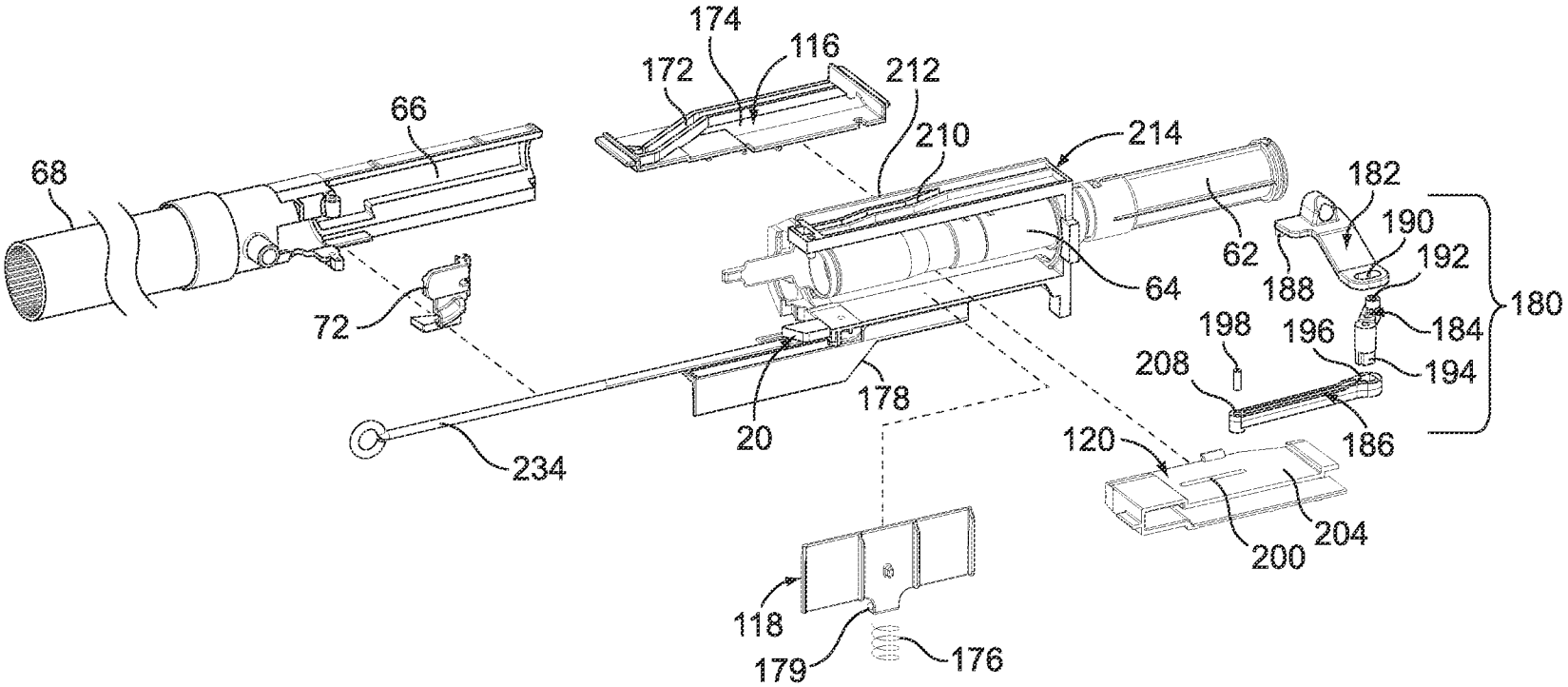
FIG. 7 is a partial exploded view of internal structures of the toy launcher apparatus including a first panel, a second panel, a projectile loader and a movement mechanism.

The projectile launching assembly 14, FIGS. 3 and 7, is mounted to the inner frame 46 which in turn is mounted to the left housing part 32. The launching assembly 14 includes a launching tube 60, an inner tube 62, a breech tube 64, a breech 66, a barrel 68, a launching spring 70, and a projectile retainer arm 72. The various structures and operation of the launching assembly are similar to that shown and describe in detail in a companion application, assigned to the assignee of the present application, entitled "Toy Dart Launcher Apparatus With Momentary Lock" and in U.S. Pat. No. 7,287,526, and are incorporated herein by reference. The launching tube 60 includes tabs and a front flange 73, and is movable by sliding over the inner tube 62 between a forward position, and a rearward or cocked position. The projectile retainer arm 72 is pivotally mounted in the breech 66 forward of a loaded projectile and serves to restrain the projectile when the breech tube 64 moves forward during a second half of a cocking cycle.

The breech tube 64 is mounted to the housing assembly to enable movement by the cocking assembly 20 between forward and rearward positions. The launching spring 70 is positioned around the launching tube 60 and is restrained by abutting one end of the launching spring 70 with a front flange 73 of the launching tube 60 and abutting the opposite end with a plurality of internal ribs 74 in an end cap 78, FIGS. 2 and 10. When the toy launcher apparatus 10 is cocked, the launching spring 70 is compressed. A safety lock mechanism prevents inadvertent expansion of the launching spring prior to the user pulling on the trigger.

Figure 10:
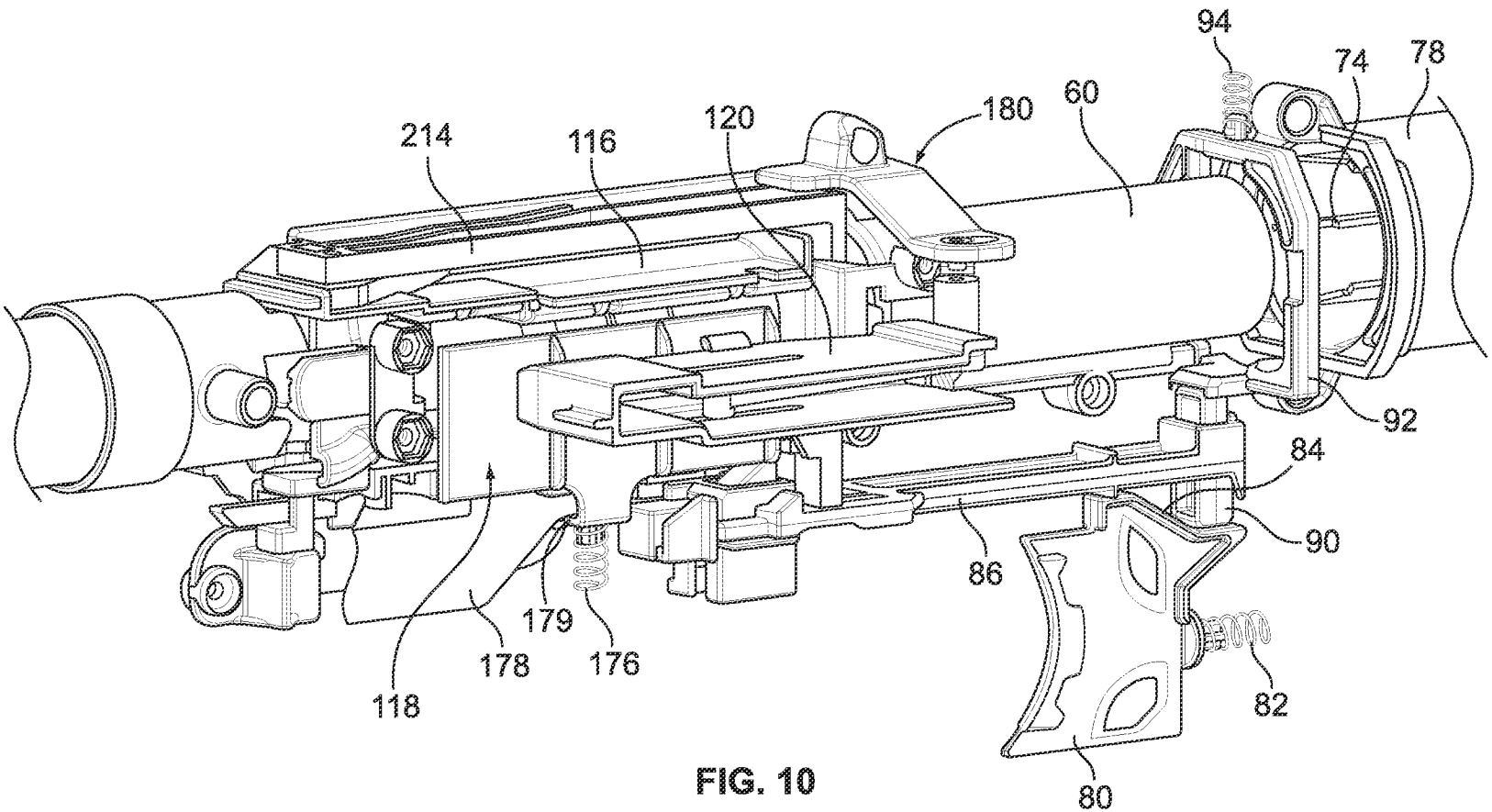
FIG. 10 is an enlarged isometric view of the first panel, the second panel and the projectile loader before cocking of the toy launcher apparatus.

The trigger assembly 16, FIG. 5, includes a trigger 80, FIG. 10, a trigger spring 82, a trigger cam surface 84, a link 86, a link spring (not shown), a vertically movable block 90, a latch ring 92, and a latch ring spring 94. During cocking of the toy launcher apparatus, the launching tube 60 is captured by the latch ring 92 and remains captured until released by the user's operation of the trigger 80. Once the launching tube 60 passes the latch ring 92, the latch ring spring 94 causes the latch ring to snap downward and capture the launching tube 60 in the launching tube's rearward position thereby also compressing the launching spring 70 and capturing it too. The link 86 is slidable between a relaxed position during which the trigger is unable to activate the launching tube and a forward position during which the link spring is compressed and the vertical block 90 is reachable by the trigger cam surface 84. The link 86 is moved forward during the cocking cycle such that the trigger cam surface 84 is properly positioned for the trigger 80, when pulled by the user, to move the block 90 vertically upward, and lift the latch ring 92 to release the launching tube 60. The launching tube then moves forward under the influence of the launching spring 70. The latch ring 92 is mounted to the inner frames 46, 48 and is biased downward by the latch ring spring 94.

When the trigger 80 is pulled, the latch ring spring 94 becomes compressed, as is the trigger spring 82. In the raised position the latch ring 92 releases the launching tube 60, and the launching spring 70 quickly pushes the launching tube 60 over the inner tube 62 to launch a projectile. The trigger spring 82 biases the trigger 80 to its forward position as soon as the user releases the trigger, and the latch ring spring 94 biases the latch ring downward.

The magazine assembly 18 includes two curved elongated walls 100, 102, FIGS. 1-4, forming a projectile container having an upper portion 104 and a lower portion 106, a projectile receiving opening 108 in the upper portion 104, a side slot 110 in the elongated wall 100, a constant force or negator spring 112 connected to a trolley structure or follower 114, a first panel or door 116, FIG. 7, operatively connected to the container upper portion 104, a second panel or door 118 operatively connected to the container upper portion 104, and a projectile loader 120, also operatively connected to the container upper portion 104. The elongated wall 102 of the magazine assembly 30 is shown permanently affixed to the main housing assembly. Indeed, the elongated wall 102 may be molded integral with the left housing half 32, the result of which is shown in FIG. 4. The other elongated wall 100 may be attached to the first wall 102 with screws through screw opening, such a screw opening 122, FIG. 1, in the elongated wall 100 which aligns with a screw receiving posts, such as the post 124, FIG. 4, in the elongated wall 102. A partial stack of projectiles 126 is shown loaded along the elongated wall 102 in FIG. 4. It is to be noted that usually when fully loaded, as many as sixteen projectiles may be stored in the projectile container using the dimensions or relative sizes of the magazine assembly and the projectiles illustrated. In FIG. 4 as shown, the magazine container would have about thirteen or fourteen projectiles, but only four are illustrated for the purpose of clarity. The negator spring 112, FIG. 3, is mounted in the container upper portion 104 and extends downward so that a lower end 130, FIG. 4, of the negator spring is attached to a shaft 132 of the trolley structure 114.

The trolley structure 114 includes side rollers 140, 142, 144, 146, FIG. 4, for riding up and down side surfaces 148, 150 of the container wall 102. Container wall rails, such as wall rails 152, 154 are provided on an inner surface 156 of the elongated wall 102 for guiding the stack of projectiles 126 and a rear surface (not shown) of the trolley structure 114. Another set of wall rails (not shown) similar to the wall rails 152, 154 are provided on the inside surface of the elongated wall 100 for facilitating the guidance of the projectiles and a front surface 160 of the trolley structure 114. A top surface 162 of the trolley structure bears against a bottom projectile 164 of the stack of projectiles 126 in the projectile container and the negator spring biases the trolley structure that in turn biases the projectile stack upward as individual projectiles are "fired" or discharged. The side slot 110, FIG. 1, allows a user to readily monitor the size of the stack of projectiles remaining, and, therefore, informs the user whether more projectiles ought to be loaded into the projectile container.

Figure 11:
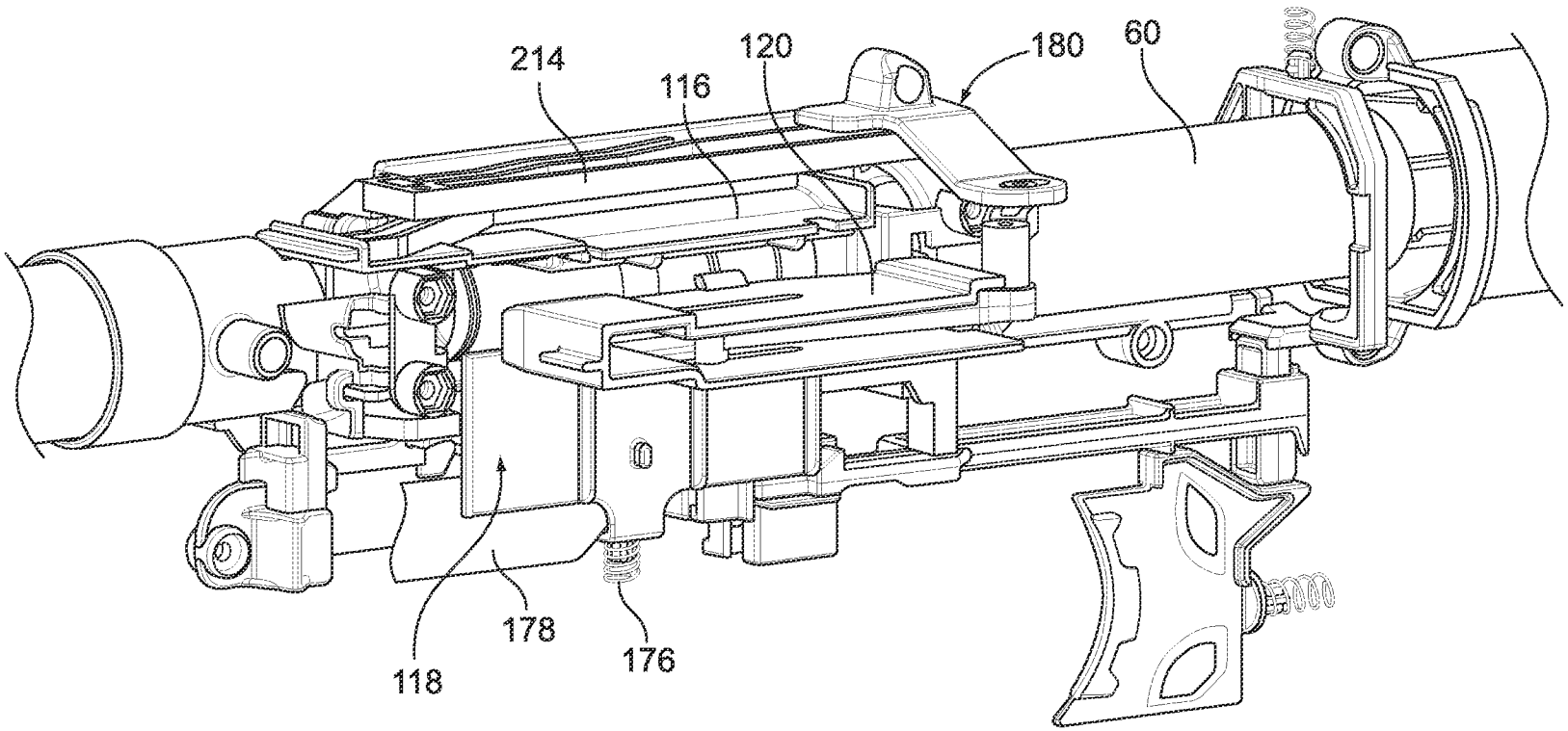
FIG. 11 is an isometric view like that shown in FIG. 10, after cocking of the apparatus has begun.
Figure 12:
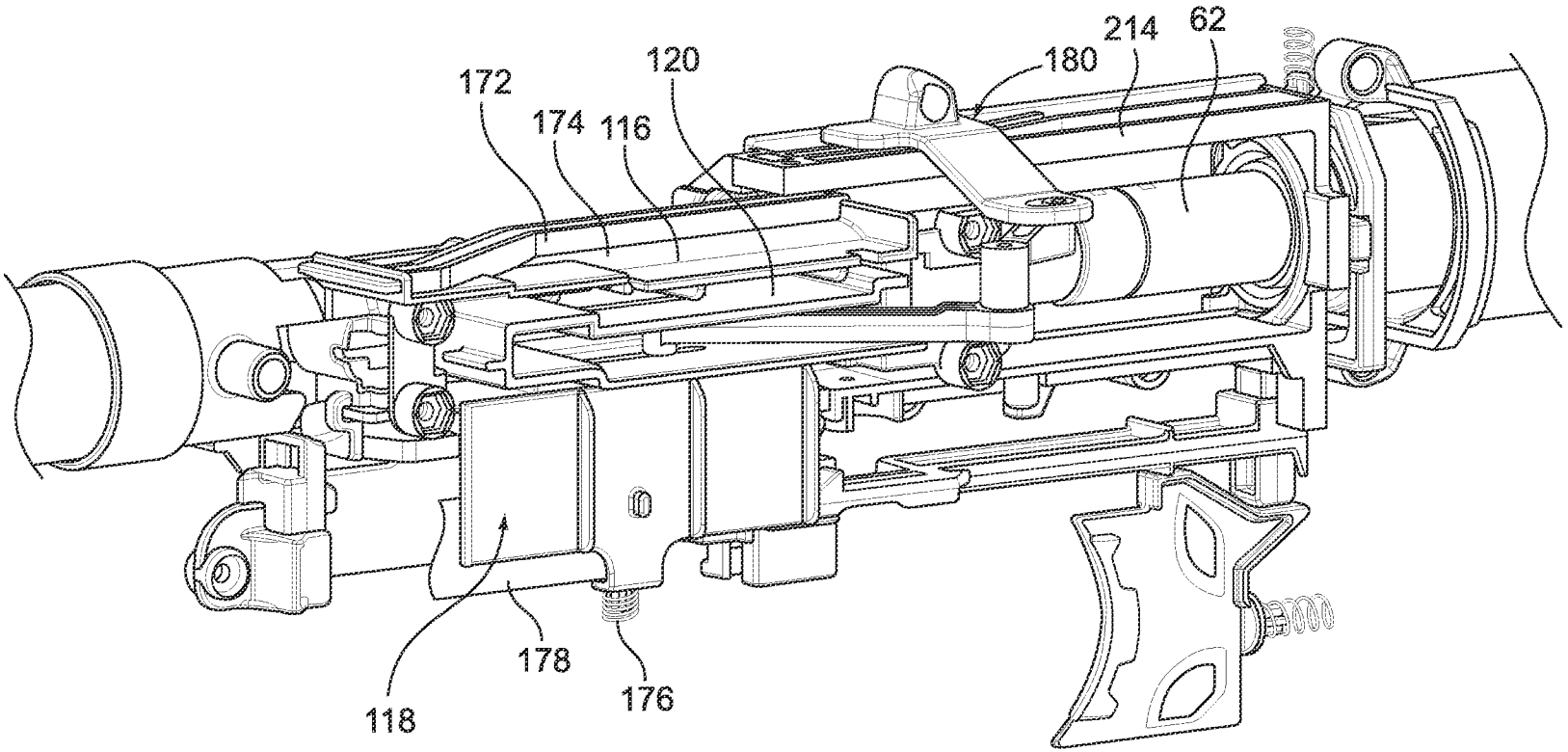
FIG. 12 is an enlarged isometric view like that shown in FIGS. 10 and 11, when the toy launcher apparatus is half cocked.
Figure 13:
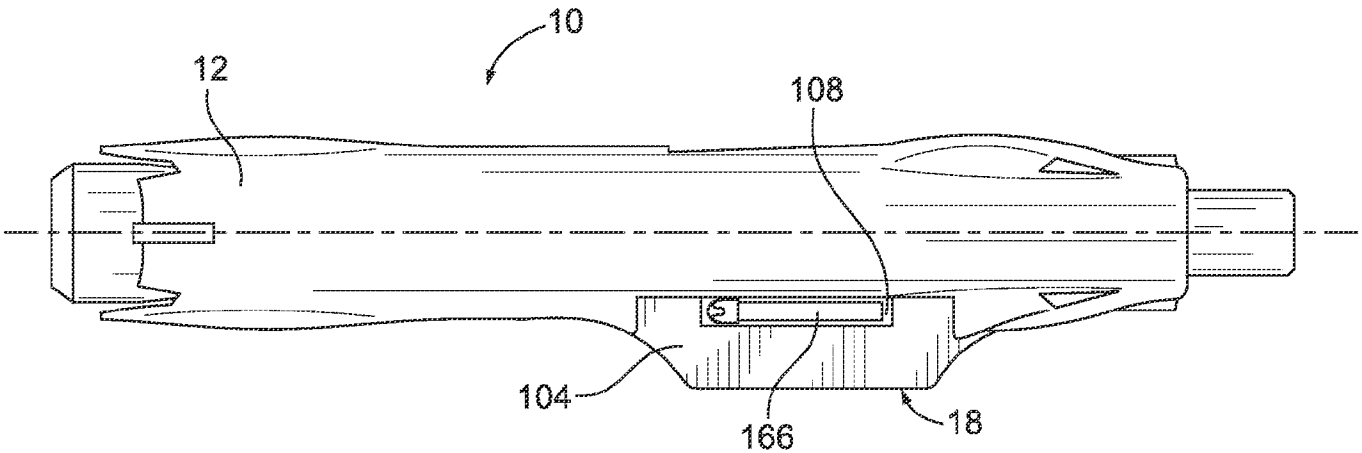
FIG. 13 is a top plan view of the toy launcher apparatus illustrating a projectile receiving opening in the magazine container in an open position.
Figure 14:
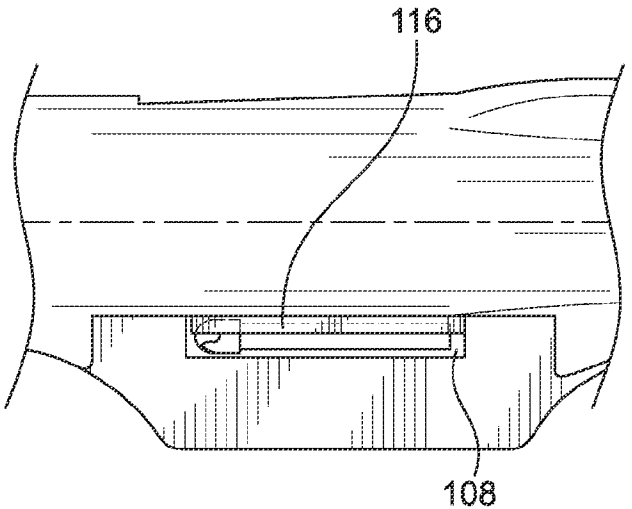
FIG. 14 is a top plan view of the toy launcher apparatus like that shown in FIG. 13, illustrating the projectile receiving opening in a partially open position.
Figure 15:
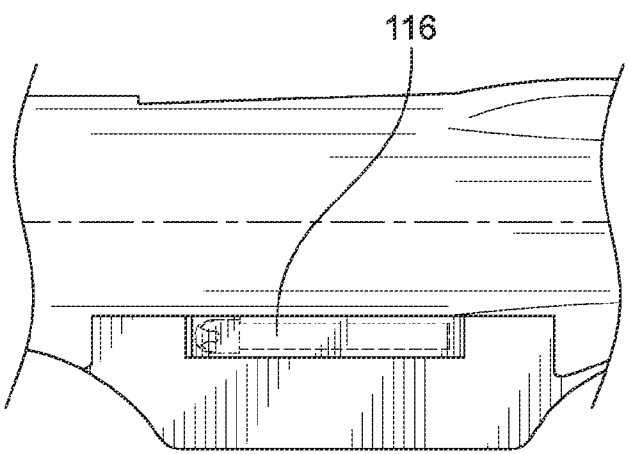
FIG. 15 is a top plan view of the toy launcher apparatus like that shown in FIGS. 13 and 14, illustrating a closed projectile receiving opening.

The important features of the present invention are due in large part to the first and second panels and the projectile loader and the ways in which they are operated. The first panel 116 is located adjacent the projectile receiving opening 108, and is generally movable horizontally between first and second positions. In the first position, as shown in FIGS. 10 and 13, the first panel is retracted away from the projectile receiving opening 108 so as to not block or interfere with the insertion of projectiles, such as the projectile 166, FIG. 13. In the second position, the first panel extends across the projectile receiving opening, as shown in FIGS. 12 and 15, so as to block or prevent the insertion of any projectiles. A partially blocked projectile receiving opening 108 is illustrated in FIG. 14, and the first panel 116 is shown part way between the first and second positions in FIG. 11. Movement by the first panel from the first position to the second position and then back again to the first position occurs during a cocking cycle. The first or horizontal panel 116 is moved by the action of a pin 170, FIG. 9, moving rearward and forward in a channel 172, FIGS. 7 and 12, formed in an upper surface 174 of the horizontal panel 116. The pin 170 is part of the cocking assembly 20 and causes, as a cam would, the horizontal panel to move between the horizontal panel's first and second positions.

The second panel 118 is mounted adjacent to the breech 66. The second panel 118 is generally vertically movable between first and second positions. In the first position, shown in FIG. 10, the second or vertical panel 118 is biased upward by a spring 176 and blocks the breech 66 to prevent more than one projectile at a time from entry into the breech to prevent jamming. In the second position, shown in FIG. 12, the vertical panel 118 is retracted downward to open or unblock the breech. The vertical panel 118 is biased by a spring 176 to the breech blocking position. A cam 178, part of the cocking assembly 20, engages a tab 179 of the vertical panel 118 to compress the spring 176 causing the vertical panel 118 to be lowered to the second position and open or unblocked the breech. A position between the first and second positions of the vertical panel 118 is shown in FIG. 11 where the spring 176 is partly compressed by the rearward movement of the cam 178.

The projectile loader 120, FIGS. 7 and 10, is also mounted adjacent to the breech 66, and is generally horizontally movable between first and second positions. In the first position, shown in FIG. 10, the projectile loader 120 is retracted out of the way of the stack of projectiles 126 which will be located between the projectile loader and the vertical panel 118 to allow the upper most projectile to be aligned opposite on one side the breech and on the other side, the projectile loader, but separated and blocked from the breech by the vertical panel 118. During a cocking cycle, the vertical panel is lowered, as shown in FIG. 12, to expose an empty breech and the projectile loader is able to extend toward the breech so as to push or insert the upper most projectile into the empty breech. A position between the first and second positions of the projectile loader 120 is shown in FIG. 11. During a second half of the cocking cycle, the projectile loader 120 returns to its first position, the vertical panel 118 returns to block the breech 66, and the horizontal panel 116 returns to its first position to unblock the projectile receiving opening 108. When the projectile loader 120 is fully retracted to the first position, the next upper most projectile is biased upward to a position aligned with the projectile loader, unless the user inserts a new projectile through the projectile receiving opening 108. The projectile loader is disposed opposite the housing opening 40 to allow access to a region around the breech.

Figure 8:
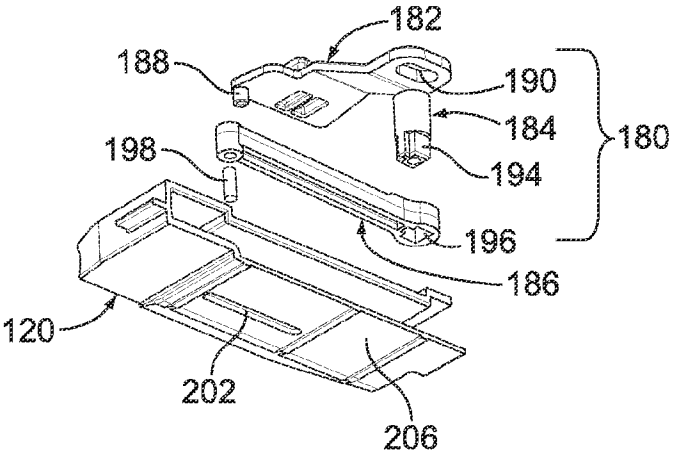
FIG. 8 is an exploded upward looking isometric view of the movement mechanism for the projectile loader.

The projectile loader 120 is operated by a movement mechanism 180, FIGS. 7 and 8, and includes a bracket 182, a link 184, and an arm 186. The bracket 182 includes a pin 188 at one end and a slot 190 at the other end. The link 184 includes a first shaft 192 at one end to ride in the bracket slot 190, and a square shaft 194 at the other end. The square shaft 194 fits into a square opening 196 in one end of the arm 186 and a pin 198 is inserted in the other end of the arm 186. The arm pin 198 rides in slots 200, 202 in upper and lower surfaces 204, 206 in the projectile loader 120. The bracket pin 188 rides in a channel 210 formed on a top wall 212 of the sliding frame 214 of the cocking assembly 20. As the sliding frame 214 moves rearward and forward during a cocking cycle, the bracket pin 188 twists or pivots the bracket 182 which in turn twists or pivots the link 184, and in turn twists or pivots the arm 186. Pivoting the arm 186 causes the arm pin 198 to ride in the slots 200, 202 and act as a cam resulting in the projectile loader moving between its first and second positions.

A major feature of the toy launcher apparatus is that loading of projectiles in the magazine container may take place at any time, except momentarily during a cocking cycle. The magazine assembly may either be fixed to the toy launching apparatus, or a magazine assembly may be removable, but does not have to be for loading. As long as there is space in the magazine container, which is easily verified by inspection of the projectile stack through the side slot 110, additional projectiles may be inserted quickly and easily through the projectile receiving opening 108 of the magazine container while the magazine container is fixed or mounted to the toy launcher apparatus. A user is able to keep the magazine container fully loaded during play as compared to a typical toy launcher apparatus where projectiles are loaded into a magazine when the magazine is separated from the toy launcher apparatus. After such a loading, the typical magazine is then connected to the toy launcher apparatus. This typical magazine remains connected to the toy launcher apparatus until all projectiles are discharged and the magazine is empty, or until there is a break in play, and an empty or partially loaded magazine is exchanged for a fully loaded magazine. In either situation, a user must disconnect or remove the empty or partially filled magazine from the toy launcher apparatus. After reloading or exchanging the magazine, a fully loaded magazine must be connected or reconnected to the toy launcher apparatus. During the period after discharging the last projectile and connection of a new or reloaded magazine, the toy launcher apparatus loses its primary function as a toy weapon because it can longer discharge a projectile. The loss of weapon usage upon reloading is in addition to a loss when the weapon is cocked. With the present invention, a toy launcher apparatus may be maintained in a fully loaded condition, almost continuously, as long as the user has time to insert projectiles during play. It is only during a cocking cycle, of very short time duration, that the magazine container projectile receiving opening 108 is blocked to prevent further projectile insertions.

Figure 9:
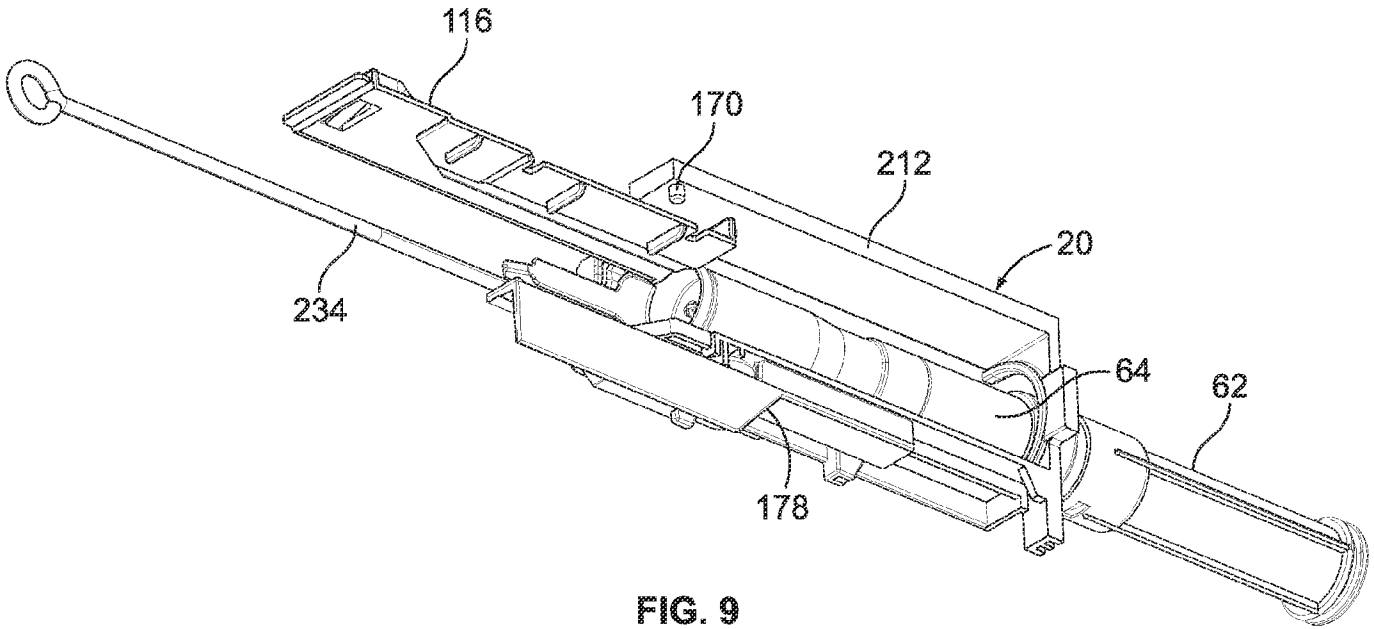
FIG. 9 is an upward looking isometric view of a sliding frame.

The cocking assembly 20 includes an external handle 230, FIGS. 1 and 2, which is mounted to guide grooves, such as the guide groove 232, FIG. 2, and mounted to a slide bracket 233, FIGS. 3 and 4, in the forward portion of the left housing part 32, a metal rod 234, FIGS. 3, 7 and 9, connected to the handle 230, and the slide frame 214, FIGS. 3, 7 and 9-12, with various cams and arms, including the channel 210, the top wall 212 and the pin 170. The handle 230 is used to hold the toy launcher apparatus 10 steady during discharge of projectiles and is operated by the user to cock the toy launcher apparatus. During operation, the handle 230 initiates a cocking cycle by moving between a forward position at the beginning of the cocking cycle as shown in solid lines in FIG. 2, and a rearward position shown in phantom lines in FIG. 2, and finishes the cocking cycle by the user returning the handle from the rearward position to the forward position. The metal rod 234 is connected to the handle 230 at one end and is connected at the other end to the slide frame 214. Moving the handle and the rod moves the slide frame 214 between a forward, breech closed position, and a rearward, breech open position. As described in detail above, when the handle, the rod and the slide frame are moved rearward, the slide frame causes the launching tube 60 to move rearward and compress the launching spring 70. The breech tube 64 also moves rearward so that the breech 66 is opened. For safety reasons, once the cocking cycle has begun and the handle moves a predetermined distance rearward, the handle cannot return to the forward position until the handle is moved completely to the rearward position. When the handle, the rod and the slide frame are at their rearward positions, the latch ring 92 captures the launching tube 60, and the trigger link 86 is repositioned. Thereafter, the user moves the handle to the forward position to complete the cocking cycle and the toy launcher apparatus is ready to be "fired".

The slide frame 214 also includes the pin 170 that rides in the channel 172 in the upper surface 174 of the horizontal panel 116. Thus, when the slide frame moved rearward, the pin 170 acts as a cam to move the horizontal panel from the open position to the blocking position so as to close the projectile receiving opening 108. The slide frame also includes the cam 178 that causes the spring 176 biasing the vertical panel 118 to the extended or upper position blocking the breech, to compress so that the vertical panel moves to its lowered or second position. The slide frame 214 includes the top wall 212 having the channel 210 to move the bracket pin 188 so as to move the projectile loader 120 from the retracted position to the extended position to insert a projectile into the breech.

It is noted that movement of the horizontal panel, the vertical panel and the projectile loader occurs in sequence to block the projectile receiving opening, to unblock the breech and to load a projectile. The timing of the movements of the horizontal panel, the vertical panel and the projectile loader is a function of such things as the geometries of the channel in the upper surface of the horizontal panel and the channel on the top wall of the sliding frame, the location of the pin on the sliding frame, the location and dimensions of the structures making up the movement mechanism and the locations of the slots in the projectile loader. Unique to the present invention is the sequence of moving the cocking assembly rearward to cause the horizontal panel to cover the projectile receiving opening so that projectiles can no longer be inserted into the magazine container, the breech to be unblocked by the vertical panel, and a projectile to be loaded by the projectile loader, and then reversing to move the projectile loader out of the way of the projectile stack, to block the breech and to open the projectile receiving opening. Shortly after the horizontal panel begins to cover the projectile receiving opening, the vertical panel moves from the breech blocking position to an unblocking position, and thereafter, the projectile loader inserts a projectile into the breech. When the user returns the external handle 230 to its forward position, the projectile loader retracts, the vertical panel returns to the breech blocking position, and the horizontal panel moves to unblock the projectile receiving opening.

The inventive structure described in detail herein provides for easy loading of the magazine container at almost any time during play in a safe manner, and the breech may be loaded very quickly while the magazine opening is momentarily blocked, another important safety feature because a user's fingers' do not get involved with the moving structures of the toy launcher apparatus during a cocking cycle. It is now clear that the toy launcher apparatus is structurally robust, relatively simple to use, relatively inexpensive, compact, fun and safe for children.

Figure 16:
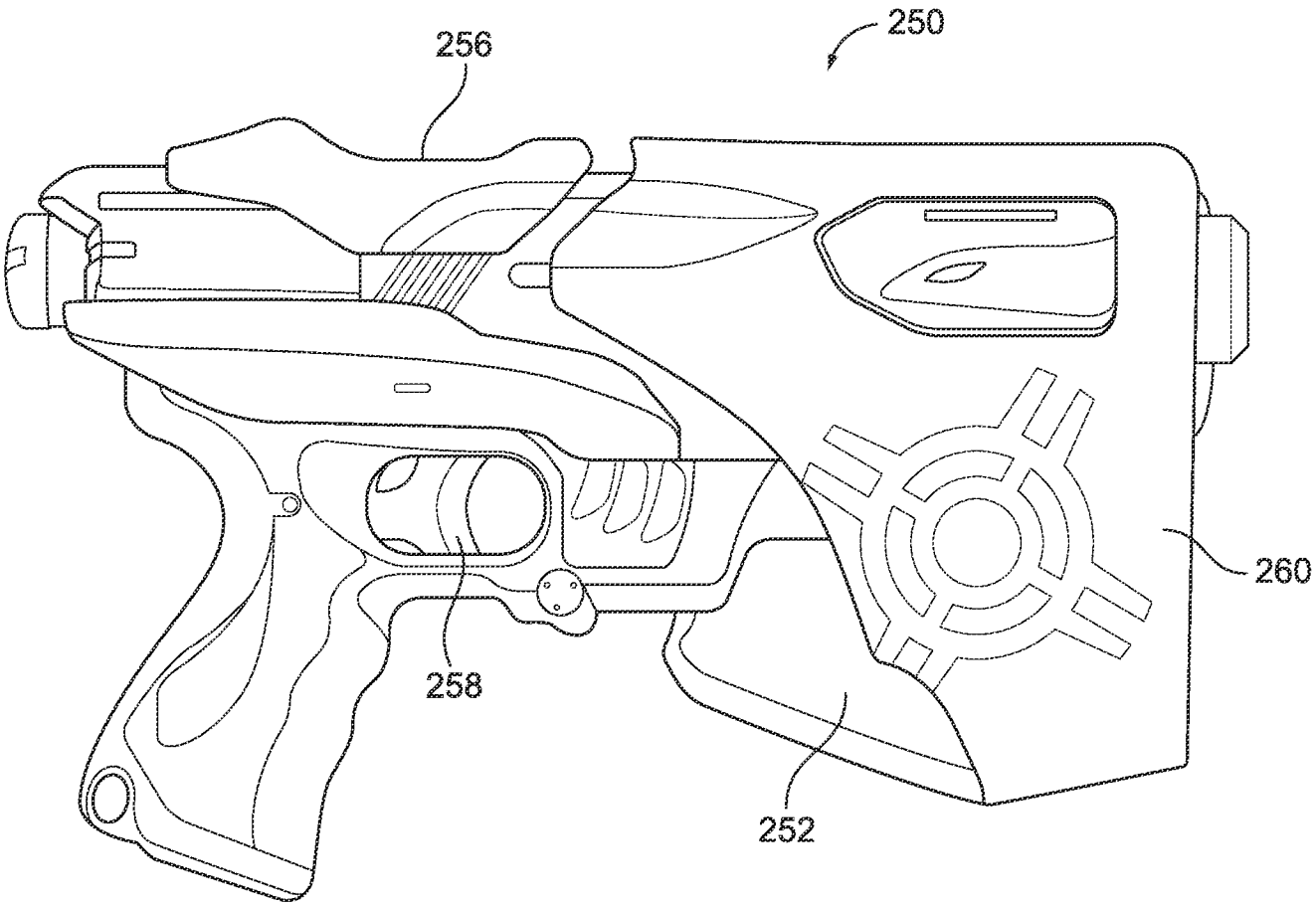
FIG. 16 is a right side elevation view of another embodiment of the present invention.
Figure 17:
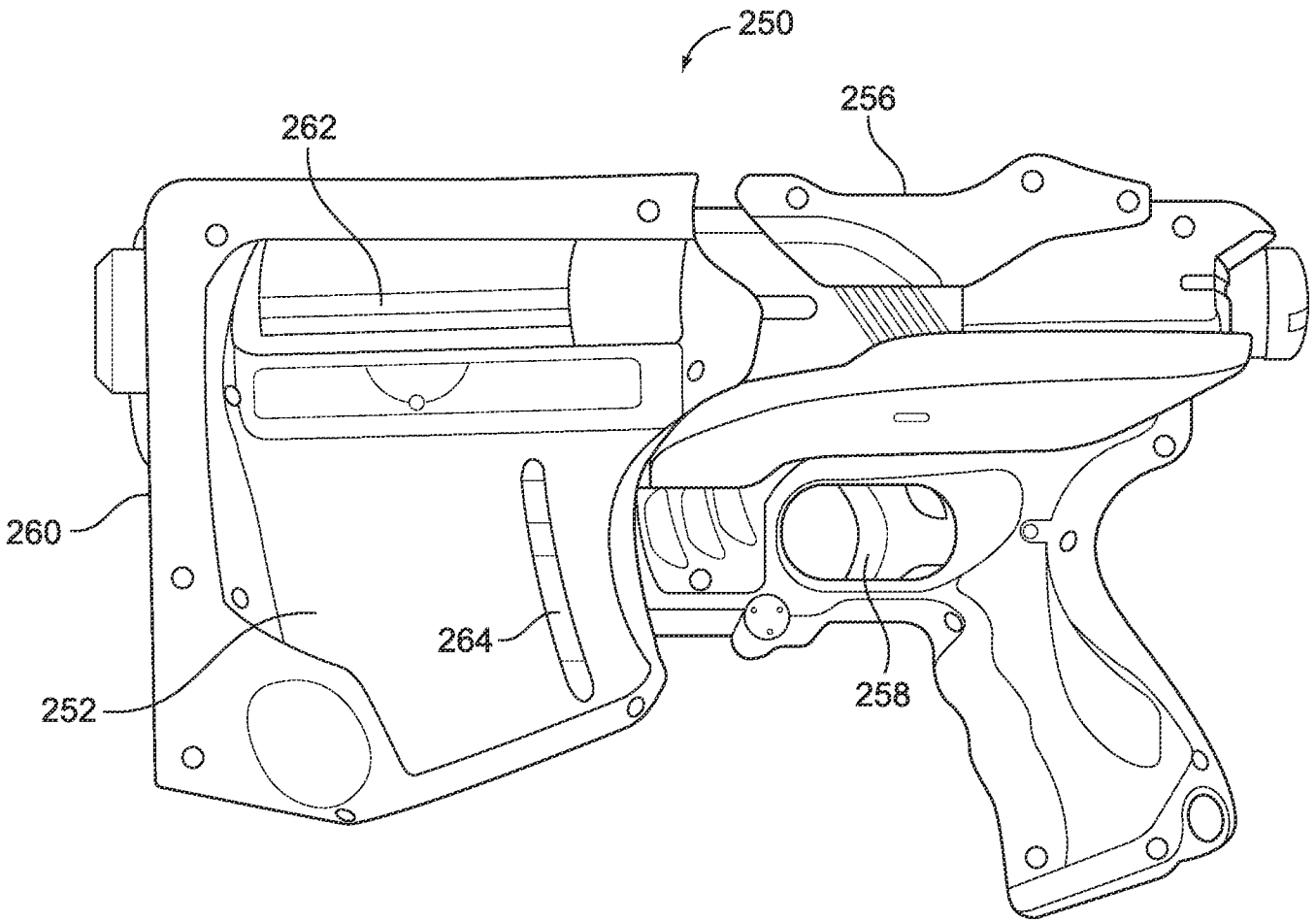
FIG. 17 is a left side elevation view of the embodiment shown in FIG. 16.
Figure 18:
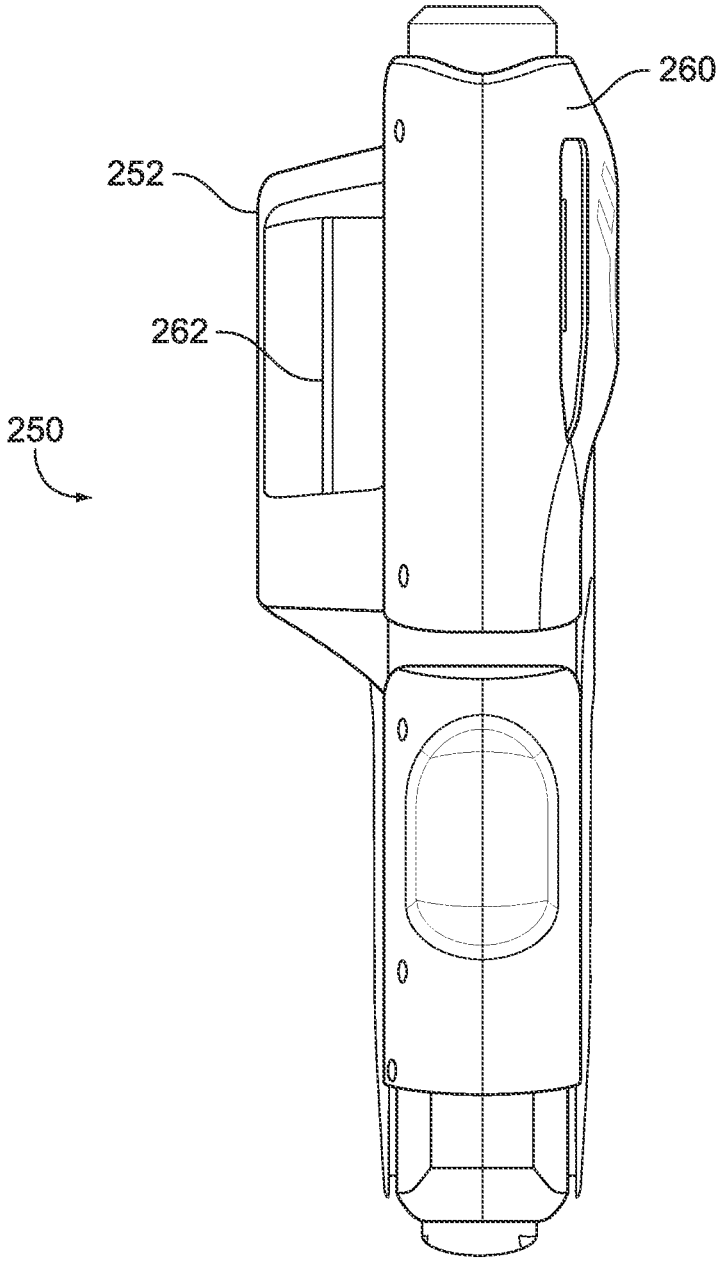
FIG. 18 is a top plan view of the embodiment shown in FIGS. 16 and 17.

As mentioned above, in the alternative, the various structures described here that are included as part of an assembly may be treated individually without regard to an "assembly", or the structures may be grouped in smaller assemblies or subassemblies. The use of assemblies here is for convenience and clarity. Another alternative may include a different launching tube structure and latch ring arrangement as well as a different trigger assembly. Yet another alternative is to configure a toy launcher apparatus 250, FIGS. 16-18, as a hand held weapon where a shorter magazine container 252 may be used, one having, for example, a six projectile capacity. The toy launcher apparatus 250 includes an outer housing 256, a launching assembly (not shown) like that of the toy launcher apparatus 10, except more compact, a trigger assembly 258 and a cocking assembly 260. Also included is a projectile receiving opening 262, a projectile stack slot 264 and horizontal and vertical panels and a projectile loader (not shown) structured like the same labeled structures in the toy launcher apparatus 10.

In operation of the toy launcher apparatus 10, (and starting a detailed operational description with the toy launcher apparatus appearing in the configuration shown in FIGS. 1-3), projectiles may be inserted into the magazine container at any time by a user pushing projectiles through the projectile receiving opening. This may be accomplished without removing the magazine container from the apparatus. A user of the toy launcher apparatus may easily determined the status of the stack of loaded projectiles by a simple inspection of the stack through the magazine side slot. After discharge of a projectile, the user reloads a projectile into the breech from the magazine container by beginning a cocking cycle which moves the horizontal panel, the vertical panel and the projectile loader in a predetermined sequence. As the external handle is moved rearward, from the handle shown in solid lines in FIG. 2, to the position shown in phantom lines, during which the launching spring is compressed to provide the energy to discharge a projectile, the horizontal panel moves across the projectile receiving opening to close the projectile receiving opening and prevent new projectiles from being loaded into the magazine container. As the horizontal panel closes, the vertical panel, after a short delay, lowers to unblock the breech. After the breech is unblocked, the projectile loader moves toward the breech to push the upper most projectile from the stack into the breech. All of there movements may be done very quickly.

When the external handle is moved back from its rearward position to its forward position during the second half of the cocking cycle, the sequence of movements of the horizontal and vertical panels and the projectile loader reverse. The projectile loader moves away from the breech toward its first position, the vertical panel then moves upward to again begin blocking the breech, followed by the horizontal panel unblocking the projectile receiving opening. After completion of the cocking cycle, the magazine container is again available to be loaded by the user without the magazine container being removed from the remainder of the toy launcher apparatus. In addition, during a cocking cycle, the breech tube moves around the just breech loaded projectile, and the retainer arm is pivoted away from a projectile blocking position such that the toy launcher apparatus is again ready to discharge a projectile. It is readily apparent that the cocking cycle may take only a moment to complete.

Figure 19:
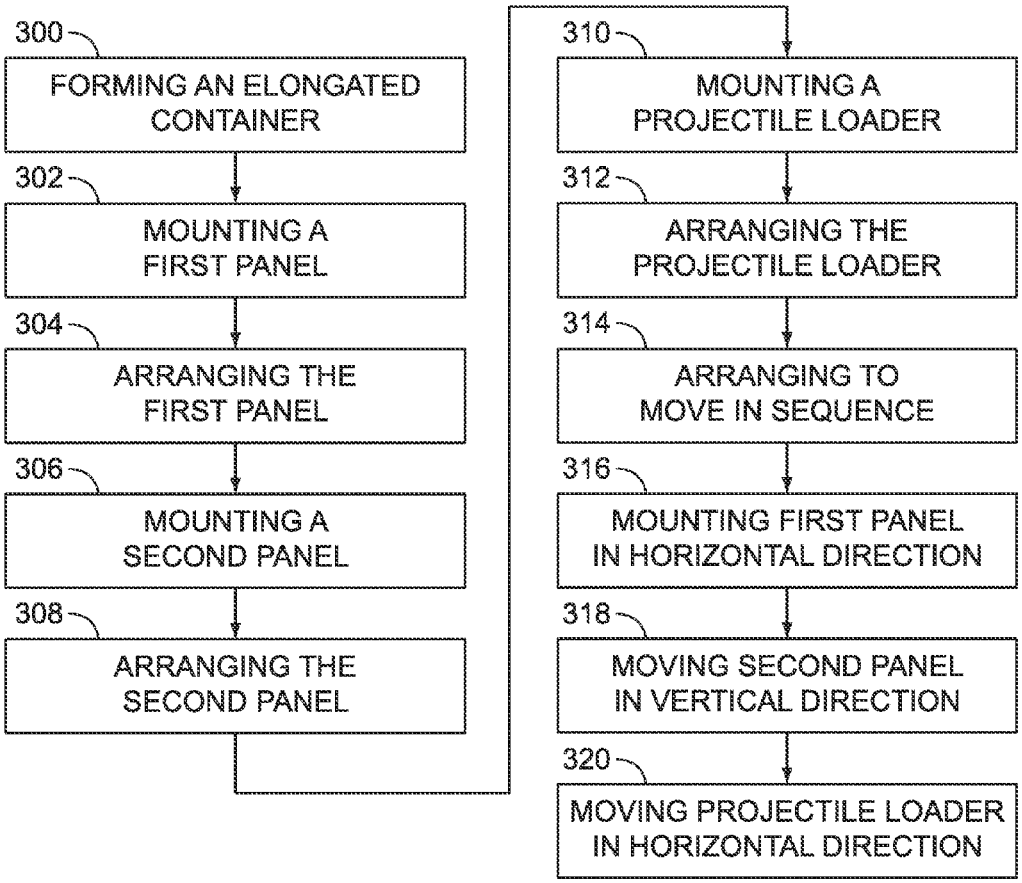
FIG. 19 is a flow diagram for a method of manufacturing the toy launcher apparatus.

The present invention also includes a method for manufacturing a magazine system for a toy projectile launcher that enables the magazine to be loaded while the magazine is attached to the toy projectile launcher, the method comprising the steps of forming an elongated container 300, FIG. 19, for storing projectiles and having a projectile receiving opening in an upper portion of the container, mounting a first panel 302 adjacent to the upper portion of the elongated container, arranging the first panel 304 to move between a first position and a second position, where in the second position the first panel blocks the projectile receiving opening, mounting a second panel 306 adjacent to the upper portion of the elongated container, arranging the second panel 308 to move between a breech blocking position and a breech unblocked position, mounting a projectile loader 310 adjacent to the upper portion of the elongated container, arranging the projectile loader 312 to move between a first position and a second position for moving or pushing a projectile from the stack of projectiles in the elongated container into the breech, arranging the first panel, the second panel, and the projectile loader to move in a sequence 314 wherein the first panel begins to move to block the projectile receiving opening before the second panel moves to unblock the breech, and the second panel moves to unblock the breech before the projectile loader moves a projectile into the breech, mounting the first panel includes arranging the first panel to move in a generally horizontal direction 316, mounting the second panel includes arranging the second panel to move in a generally vertical direction 318, and mounting the projectile loader includes arranging the projectile pusher to move in a generally horizontal direction 320.

The toy launcher apparatus disclosed in detail above has great play value, is fun to use and easy to operate and may be done so safely, and with a robust, but simple structure, that is produced at reasonable cost. In the alternative, while a toy is described, a real weapon may be configured as discussed to allow easy and continuous loading (except during the actual cocking cycle). Still another alternative includes the toy launcher apparatus having a removable magazine container although it is to be understood that such a magazine container may still be loaded while being attached to the toy launcher apparatus.

From the foregoing, it can be seen that there has been provided features for an improved toy apparatus that simulates a real pump action weapon and a disclosure of the method of the toy's manufacture. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

a housing;

a projectile launching assembly mounted to the housing, the launching assembly including a breech;

a trigger assembly mounted to the housing and operatively connected to the projectile launching assembly to activate the projectile launching assembly;

a magazine container mounted to the housing, the magazine container having a projectile receiving opening in an upper portion to enable loading of projectiles into the magazine container without removing the magazine container from the housing;

a first panel operatively connected to the housing adjacent to the magazine container upper portion and movable between first and second positions, and when in the first position the first panel does not block the projectile receiving opening in the upper portion of the magazine container, and when in the second position the first panel blocks the projectile receiving opening in the upper portion of the magazine container;

a second panel operatively connected to the housing adjacent to the breech of the launching assembly and movable between first and second positions, and when in the first position the second panel blocks the breech, and when in the second position the second panel does not block the breech;

a projectile loader operatively connected to the magazine container and movable between first and second positions, and when moving from the first position to the second position the projectile loader inserts a projectile into the breech; and a cocking assembly mounted to the housing, the cocking assembly to enable movement of the first panel, the second panel and the projectile loader.

2. The toy launcher apparatus of claim 1, wherein:

the cocking assembly includes a handle operatively connected to the first panel, the second panel and the projectile loader.

3. The toy launcher apparatus of claim 1, wherein:

the cocking assembly includes a slide frame; and the first panel is movable by the slide frame.

4. The toy launcher apparatus of claim 1, wherein:

the cocking assembly includes a slide frame; and the second panel is movable by the slide frame.

5. The toy launcher apparatus of claim 1, wherein:

the cocking assembly includes a slide frame; and the projectile loader is movable by the slide frame.

6. The toy launcher apparatus of claim 1, wherein:

the first panel is movable in a generally horizontal direction;

the second panel is movable in a generally vertical direction; and the projectile loader is movable in a generally horizontal direction.

7. The toy launcher apparatus of claim 1, wherein:

the cocking assembly includes a slide frame;

the first panel is movable by the slide frame;

the second panel is movable by the slide frame; and the projectile loader is movable by the slide frame.

8. The toy launcher apparatus of claim 7, wherein:

the first panel, the second panel and the projectile loader move in sequence wherein the first panel begins moving from its first position to its second position before the second panel begins moving from its first position to its second position, and the second panel begins moving from its first position to its second position before the projectile loader begins moving from its first position to its second position.

9. The toy launcher apparatus of claim 8, wherein:

the first panel is movable in a generally horizontal direction;

the second panel is movable in a generally vertical direction; and the projectile loader is movable in a generally horizontal direction.

10. The toy launcher apparatus of claim 9, wherein:

the housing includes an opening disposed opposite to the projectile loader; and including a lockable door to enable the housing opening to be covered.

* * * * *